US011441301B2

(12) United States Patent
Cen

(10) Patent No.: US 11,441,301 B2
(45) Date of Patent: Sep. 13, 2022

(54) PRESS-TYPE OVERFLOW DRAINAGE DEVICE FOR WATER CONTAINER

(71) Applicant: Ningbo Bosheng Valve & Fitting Co., Ltd Co., Ltd., Zhejiang (CN)

(72) Inventor: Difeng Cen, Zhejiang (CN)

(73) Assignee: NINGBO BOSHENG VALVE & FITTING CO., LTD CO., LTD., Zhejiang (CN)

( * ) Notice: Subject to any disclaimer, the term of this patent is extended or adjusted under 35 U.S.C. 154(b) by 0 days.

(21) Appl. No.: 15/734,828

(22) PCT Filed: Jun. 3, 2019

(86) PCT No.: PCT/CN2019/089750
§ 371 (c)(1),
(2) Date: Dec. 3, 2020

(87) PCT Pub. No.: WO2019/233356
PCT Pub. Date: Dec. 12, 2019

(65) Prior Publication Data

US 2021/0180302 A1 Jun. 17, 2021

(30) Foreign Application Priority Data

Jun. 4, 2018 (CN) ..... 201810564905.X
Jun. 4, 2018 (CN) ..... 201820856427.5

(51) Int. Cl.
*E03C 1/232* (2006.01)
*E03C 1/23* (2006.01)

(52) U.S. Cl.
CPC ..... *E03C 1/232* (2013.01); *E03C 1/2304* (2013.01); *E03C 2001/2317* (2013.01)

(58) Field of Classification Search
CPC . E03C 1/232; E03C 1/2304; E03C 2001/2317
(Continued)

(56) References Cited

U.S. PATENT DOCUMENTS 4,594,738 A * 6/1986 Gebert ..... E03C 1/232 4/680
2007/0289059 A1* 12/2007 Schintler ..... E03C 1/2304 4/688
2016/0177554 A1* 6/2016 Yu ..... E03C 1/2304 4/685

FOREIGN PATENT DOCUMENTS

CN 2377290 Y 5/2000
CN 2390922 Y 8/2000
(Continued)

*Primary Examiner* — Tuan N Nguyen
(74) *Attorney, Agent, or Firm* — Muncy Geissler Olds & Lowe P.C.

(57) ABSTRACT

A press-type overflow drainage device for water container includes a lifting control mechanism provided with an up and down movement member and a fixed component with a through hole for the movement of the up and down movement member. The lifting control mechanism provides two upper and lower stop positions. The drainage device includes a horizontal button assembly which is provided with a button, and connected with the up and down movement member through a joint member while the corresponding up and down movement member stops in the upper and lower stop positions. The button has the press-in and stop and pop-up and stop positions at the front and rear of the horizontal position. The button is located at the overflow outlet and can control the drainage device of the water container.

9 Claims, 7 Drawing Sheets

(58) Field of Classification Search
USPC ..... 4/679, 680, 682–685
See application file for complete search history.

(56) References Cited

FOREIGN PATENT DOCUMENTS

| | | | |
|---|---|---|---|
| CN | 102535597 | A | 7/2012 |
| CN | 202509584 | U | 10/2012 |
| CN | 107965017 | A | 4/2018 |
| CN | 108755864 | A | 11/2018 |
| CN | 208650187 | U | 3/2019 |
| EP | 1703027 | B1 | 8/2016 |

* cited by examiner

PRESS-TYPE OVERFLOW DRAINAGE DEVICE FOR WATER CONTAINER

TECHNICAL FIELD

The present invention relates to an press-type overflow drainage device for water container. The water container can be a water container with a water outlet and an overflow outlet, such as a bathtub, a water tank, etc.

BACKGROUND

At present, the drainage devices of water containers such as bathtubs, cleaning pools, sinks, etc. or water containers with considerable depth or area of ponding are mainly as follows:

1. Plug, draining/storing water is troublesome and not beautiful enough;
2. The bounce type/turning plate type, it needs to extend into water when draining, which is not hygienic; it needs to bend down when storing water, which is not convenient enough;
3. Overflow turntable control type, the operation feel is not good;
4. Table mounted console control type, the operating parts are usually installed on the table, which is inconvenient to take care of;
5. Overflow outlet press type, its button of one type is reset after each action, which is not easy to identify the drainage/storage mode and easy to operate by mistake; the button of another type uses the pressing structure of ball point pen, which is floating and has poor hand feeling, and it is not easy to distinguish the drainage/storage mode, and its service life is not long, it is easy to be damaged and the handle is not good.

SUMMARY

The technical problem to be solved by the present invention is to provide A press-type overflow drainage device for water container, the button of which is located at the overflow outlet and can control the drainage device of the water container, which is easy to operate and can indicate the drainage/storage mode of the drainage device. Therefore, the present invention adopts the following technical scheme:

A press-type overflow drainage device for water container, comprising a drainage cover mechanism and a connecting steel wire, which the drainage cover mechanism including a drainage cover and its transmission mechanism; it is characterized in that:

The drainage device also includes a lifting control mechanism; the lifting control mechanism is provided with up and down movement member and a fixed component with a through hole for the movement of the up and down movement member; one end of the connecting steel wire is connected with the up and down movement member, and the other end is connected with the transmission mechanism; the lifting control mechanism provides two upper and lower stop positions, so that the up and down movement member can stop at different heights, operate between the lower stop position and the upper stop position with the help of external force pressing and storing and releasing spring energy, and correspondingly push and pull the connecting steel wire to make the transmission mechanism in the first working state and the second working state; the first working state corresponds to the closing or opening state of the drainage cover, and the second working state corresponds to the opening or closing state of the drainage cover;

The drainage device also comprises a horizontal button assembly which is provided with a button, and connected with the up and down movement member through a joint member while the corresponding up and down movement member stops in the upper and lower stop positions, and the button has the press-in and stop and pop-up and stop positions at the front and rear of the horizontal position, and the press-in and stop position corresponds to the first working state of the transmission mechanism, and the pop-up and stop position corresponds to the second working state of the transmission mechanism.

Based on the above technical solutions, the present invention may also adopt or combine the following further technical solutions:

The lifting control mechanism is provided with the spring that pushes the up and down movement member from the bottom to top, and accumulates energy when the external force is pressing on the button, and releases the energy after the external force is released; the lifting control mechanism is provided with two upper and lower gears and a sliding groove between the two gears corresponding to the upper and lower stop positions, and the lifting control mechanism is also provided with a blocking hook matched with the gear positions and the sliding groove.

The transmission mechanism includes a swing arm and a driving rod which rotate synchronously through a shaft connection, the steel wire is connected with the swing arm, the drainage cover is connected with a lifting shaft, and the lifting shaft is laid on the driving rod; the angular position of the driving rod rotating to the corresponding first working state is a low position, and the angular position of the driving rod rotating to the corresponding second working state is a high position.

The horizontal button assembly includes a horizontal sliding member, a rotary rod, a shaft and a swing arm, and the button is connected with the horizontal sliding member; the swing arm and the driving rod rotate synchronously through a shaft connection; the swing arm and the joint member are rotatably connected; the horizontal sliding member and the rotary rod are movably clamped; the horizontal sliding member and the rotary rod can push each other, and the horizontal sliding member and the button are also positioned when the up and down movement member stops in the upper and lower stop positions.

The rotary rod and the swing arm are respectively connected to both sides of the shaft.

The horizontal sliding member is provided with a control groove, and the horizontal sliding member is movably clamped through the connection part of the control groove and the rotary rod.

One end of the joint member is provided with a joint ball, and the upper end of the up and down movement member is connected with a ball cover, and the joint ball is clamped between the ball cover and the upper end of the up and down movement member.

The size of the button is smaller than that of the inner hole of the overflow outlet cover of the water container, and when the button is in the pressed in position, the button is located in the inner hole.

The overflow body of the overflow device of the water container is connected with the overflow pipe, the horizontal sliding member and the rotary rod are arranged in the overflow body, the shaft in the horizontal button assembly can be rotatably connected with the overflow body, the overflow outlet cover of the water container is connected with the overflow body, and a guide component is connected to the portion of the overflow outlet cover inserted into the overflow body or on the overflow body with screws screwed in from the horizontal front; an installation compartment with an openable cover is arranged on the side of the overflow body, and the lower part of the installation compartment is fixedly connected with the fixed component; the swing arm and joint member are arranged in the installation compartment, and the installation compartment has space for the movement of the joint member.

The lower part of the fixed component is connected with a bracket, and the spring is in the bracket and pushes up the up and down movement member.

Due to adopting the technical scheme of the present invention, the present invention can utilize the cooperation of the lifting control mechanism, the horizontal button and the overflow outlet, and the button is located at the overflow outlet and can control the drainage device of the water container, which is easy to operate and can indicate the drainage/storage mode of the drainage device.

DETAILED DESCRIPTION

Figure 1:
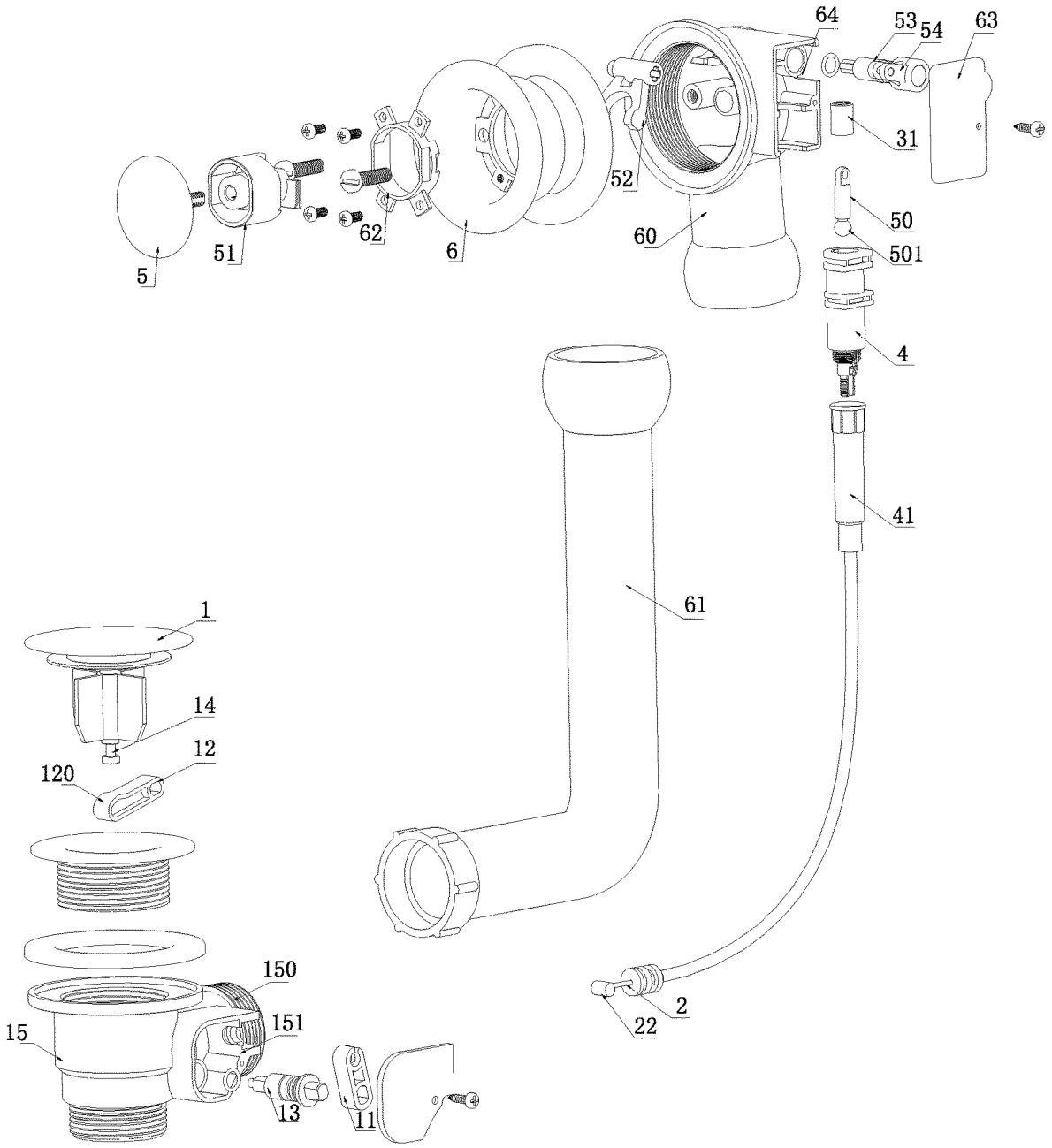
FIG. 1 is an exploded view of an embodiment of the press-type overflow drainage device provided by the present invention.

The water container in the following embodiment of the present invention takes a bathtub as an example.

Refer to the attached figure. The press-type overflow drainage device of the water container comprises a drainage cover mechanism and a connecting steel wire 2. The drainage cover mechanism comprises a drainage cover 1 and its transmission mechanism.

The drainage device also comprises a lifting control mechanism; the lifting control mechanism is provided with an up and down movement member 3 and a fixed component 4 with a through-hole 40 for the movement of the up and down movement member 3. The up and down movement member 3 is generally a strip-shaped piece, and the fixed component 4 is in sleeve shape outside the up and down movement member 3, and the fixed component 4 can be connected by several parts. One end of the connecting steel wire 2 is connected with the up and down movement member 3, and the other end is connected with the transmission mechanism. The lifting control mechanism provides the upper and lower stop positions, so that the up and down movement member 3 can stay at different heights, operate between the lower stop position and the upper stop position with the help of external force pressing and storing and releasing spring energy, and correspondingly push and pull the connecting steel wire 2 to make the transmission mechanism in the first working state and the second working state. In this embodiment, the first working state corresponds to the closing state of the drainage cover, and the second working state is opposite to the first working state, so it corresponds to the opening state of the drainage cover.

The drainage device also includes a horizontal button assembly which is provided with a button 5, and when the button 5 is connected to the up and down movement member 3, the horizontal force is turned into the force in the up and down direction.

The horizontal button assembly is connected to the up and down movement member 3 through the joint member 50, which corresponds to the up and down movement member 3 staying in the upper and lower stop positions. The button 5 has a press-in stay position and a pop-up stay position at the front and rear of the horizontal position. The press-in stay position corresponds to the first working state of the transmission mechanism, and the pop-up stay position corresponds to the second working state of the transmission mechanism. The present invention enables the button 5 to be in two positions stably corresponding to the two working states, so that the user can clearly distinguish the different working states.

The size of the button 5 is smaller than that of the inner hole 65 of the overflow outlet cover 6. When the present invention is combined with the overflow device, the button 5 is located inside the inner hole 60 when it is in the press-in stay position. The outer edge of the overflow outlet protects the button 5 to prevent the button 5 from being accidentally triggered to drain water when the water container is in a water storing state. For the pop-up stay position, the button can be designed to slightly protrude from the overflow outlet or flush with the overflow outlet to make the appearance be beautiful.

The horizontal button assembly comprises a horizontal sliding member 51, a rotary rod 52, a shaft 53, a swing arm 54 and a joint member 50. The button 5 is connected with the horizontal sliding member 51 through a thread. The rotary rod 52 and the swing arm 54 rotate synchronously through the connection of the shaft 53, the swing arm 54 is rotatably connected with the joint member 50, the horizontal sliding member 51 and the rotary rod 52 are movably clamped, so that their connecting portions are not only connected with each other, but also can be adapted to avoid collision when the rotary rod 52 rotates. The horizontal sliding member 51 and the rotary rod 52 can push each other, and when the up and down movement member 3 stays in the upper and lower positions, the horizontal sliding member 51 is also positioned. Preferably, a control groove 510 is arranged on the horizontal sliding member 51, and the direction of the control groove 510 is along the track of the connecting part 520 of the rotary rod 52 when rotating, and the horizontal sliding member 51 is movably clamped with the connecting part 520 of the rotary rod through the control groove 510.

The rotary rod 52 and the swing arm 54 are respectively connected to both sides of the shaft 53, so that the lifting control mechanism can be at the side of the overflow device of the water container, thus saving the installation space. Preferably, in terms of assembly relationship and position, the included angle between the rotary rod 52 and the swing arm 54 is acute angle, and the rotary rod 52 is always tilted downward, the swing arm 54 is always slightly tilted upward, and the upward tilt angle is no more than 40°; in the horizontal direction, the connecting part between the swing arm 54, and the joint member 50 is always in the range from the shaft 52 to the button. So as to provide the working sensitivity, increase the handle feeling and reduce the installation space.

One end of the joint member 50 is provided with a joint ball 501, and the upper end of the up and down movement member is connected with a ball cover 31, and the joint ball 501 is clamped between the ball cover 31 and the upper end of the up and down movement member 3.

The overflow body 60 of the overflow device of the water container, i.e., the installation shell at the back of the overflow outlet, is connected with the overflow pipe 61; the horizontal sliding member 51 and the rotary rod 52 are arranged in the overflow body 60; the shaft 53 is rotatably connected with the overflow body 60; the overflow outlet cover 6 of the water container is threadedly connected with the overflow body 60, so that the present invention combined with the overflow device of the water container is installed on the water container. In the overflow body 60, the guide component 62 of the horizontal sliding member 51 can be separately installed, and the guide component 62 is connected to the part of the overflow outlet cover 6 inserted into the overflow body 6 or connected to the overflow body 6 with the screws screwed in from the horizontal front. An installation compartment 64 with an openable cover 63 is arranged on the side of the overflow body 60. The fixing component 4 is fixedly connected to the lower part of the installation compartment 64. The swing arm 53 and the joint member 50 are arranged in the installation compartment 64, and the installation compartment 64 has a space for the swing arm 54 and the joint member 50 to move. Thus it is convenient to install, saves space and ensures the connection strength.

The lower part of the fixed component 4 is connected with the bracket 41, and the spring 7 is in the bracket 41 and pushes up the up and down movement member 3. The spring 7 can also be located inside the fixed component 4 and between the up and down movement member 3 and the fixed component 4, and the spring 7 can also be in other positions, as long as the position enables the up and down movement member to obtain the lifting and pulling force from the head to the tail (i.e. from bottom to top). When an external force is applied to press the button 5, the spring 7 accumulates energy, and after the external force is released, the spring 7 releases energy. The lifting control mechanism is provided with two upper and lower gears corresponding to the upper and lower stop positions and a sliding groove between the two gears, and the lifting control mechanism is also provided with blocking hooks matched with the gear positions and the sliding groove.

The two gears and sliding groove can be arranged on the up and down movement member 3, or on the fixed component 4 and other fixed components, and it is preferred to set on the up and down movement member:

In this embodiment, the surface of the up and down movement member 3 is provided with the upper and lower gears, which are the first gear 71 and the second gear 72, respectively. The first gear and the second gear are respectively at different heights on the surface of the up and down movement member 3, and the surface of the up and down movement member 3 is provided with a first one-way sliding groove of the blocking hook part to make the up and down movement member 3 cooperate with the blocking hook part 32 from the first gear to the second gear, and the surface of the upper and lower moving part 3 is also provided with a second one-way sliding groove to make the up and down movement member 3 move from the second gear to the first gear; the first one-way sliding groove comprises a first sliding groove section 81 starting from the first gear and a second sliding groove section connected with the first sliding groove section and towards the second gear 82, which the connection part is farther away from the head of the up and down movement member 3 than the second gear; the second one-way sliding groove comprises a third sliding groove section 83 starting from the second gear position and a fourth sliding groove section 84 connected with the third sliding groove section, which the connection part is farther away from the head of the up and down movement member 3 than the second gear, and the fourth sliding groove and the first sliding groove is connected with first gear.

When the two gears and sliding groove can be set on the up and down movement member 3, the blocking hook is correspondingly arranged on the fixed component 4 and other fixed parts. The blocking hook is connected to the fixed component 4, and the fixed component 4 is provided with a coil spring for fixing the blocking hook, or is fixedly connected to the fixed component 4 by other methods.

In order to realize the one-way relative movement of the sliding groove and the blocking hook part 32, it can be realized not only by the design of the groove wall of the sliding groove or the design of the groove bottom of the sliding groove. In this embodiment, the design of the groove bottom is adopted to realize that the switch action is more reliable and the service life is longer. The scheme is as follows: the first sliding groove section is connected with the second sliding groove section in a step shape, at the connection 91, the groove bottom surface of the second sliding groove section is lower than the groove bottom surface of the first sliding groove section; the third sliding groove section is connected with the fourth sliding groove section in a step shape, at the connection 92, the groove bottom surface of the fourth sliding groove section is lower than the groove bottom surface of the third sliding groove section; the second sliding groove section has a downward step 93 near the second gear position; At the connection 94, the groove bottom surface of the first sliding groove section is lower than the groove bottom surface of the fourth sliding groove section.

For the lifting control mechanism, a axial movement guide structure of the up and down movement member 3 can be set to prevent the up and down movement member 3 from rotating, and the blocking hook can swing to a certain extent to match with the sliding groove on the non rotating up and down movement member 3; or, the axial movement guiding structure is not provided, and the up and down movement member 3 are allowed to rotate at a certain angle to realize the cooperation between the sliding groove and the blocking hook, but the former have a better hand feeling in use.

The steel wire 2 can be connected with the up and down movement member 3 through a nut 33 threaded with the head of the up and down movement member 3, and the upper end connector 21 of the steel wire is clamped between the up and down movement member 3 and the nut 33, and is connected with the up and down movement member 3.

The transmission mechanism comprises a swing arm 11 and a driving rod 12. The swing arm 11 and the driving rod 12 rotate synchronously through the connection of a shaft 13, and the lower end connector 22 of the steel wire is clamped with the swing arm 11; the drainage cover 1 is threaded connected or connected by other means with the lifting connecting rod 14 under it, and a sealing gasket can also be arranged under the lower part of the drainage cover; the lifting connecting rod 14 and the driving rod 12 are not connected, but the end of the lifting connecting rod 14 is placed on the driving rod 12 during lifting and water discharge state. The transmission mechanism can also be a rotatable multi-section connecting rod, and the steel wire is connected with the middle part of one of the connecting rods.

When the driving rod 12 is rotated, the angular position corresponding to the first working state of the shift lever 12 is a low position, and is slightly inclined downward, and the angular position corresponding to the second working state is a high position. The supporting position 120 of the driving rod is preferably curved or cylindrical to improve the matching effect with the lifting connecting rod 14.

No. 15 in the attached figures is the outer cylinder of the drainage device, which is installed at the water outlet of the water container. The overflow pipe 61 is connected to the connection port 150 on the side of the outer cylinder, the side of the outer cylinder is also provided with a transmission box 151 which the swing arm 11 is inside, and the shaft 13 passes through the outer cylinder wall, and is connected with the driving rod 12 in the outer cylinder 15.

During operation, the pressure is applied on the button 5, the horizontal sliding member 51 slides, the rotary rod 52 and the swing arm 54 rotate synchronously, and the up and down movement member are driven to move through the joint member 50. After the pressure is removed, the up and down movement member enters one of the stop positions by relying on the restoring force of the spring 7, and the button 5 is correspondingly and stably in the pressed in or popped out position according to its position, According to its position, it indicates whether the water container is in a water accumulation state or a water drainage state.

Figure 2:
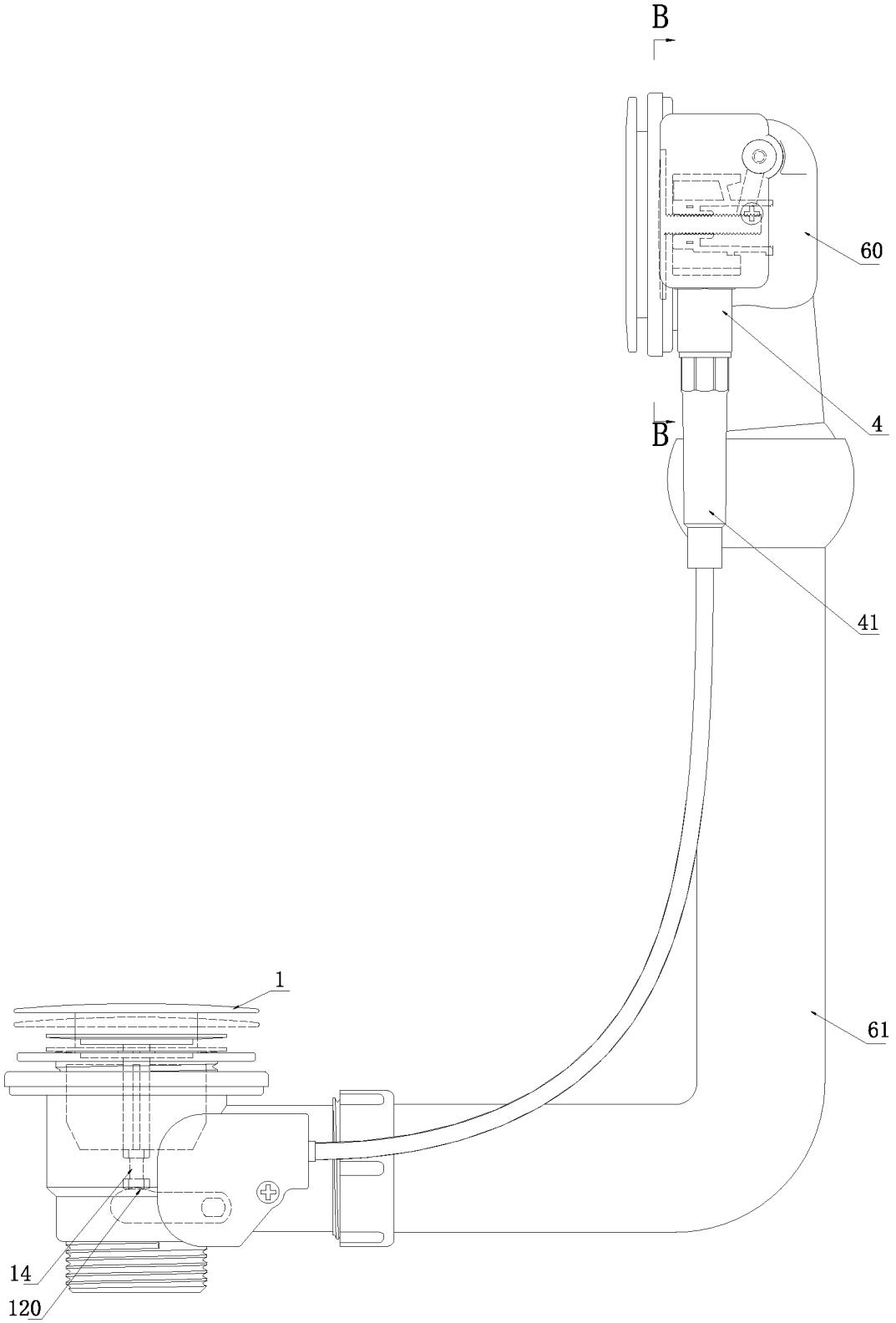
FIG. 2 is a side view of the embodiment of the press-type overflow drainage device provided by the present invention.
Figure 3:
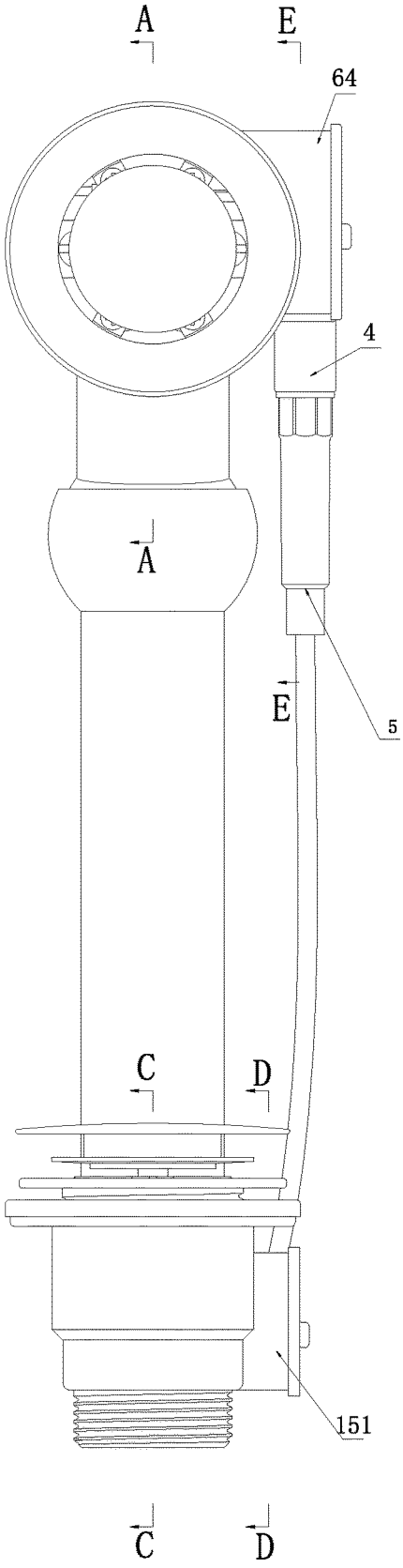
FIG. 3 is a front view of the embodiment of the press-type overflow drainage device provided by the present invention.
Figure 4:
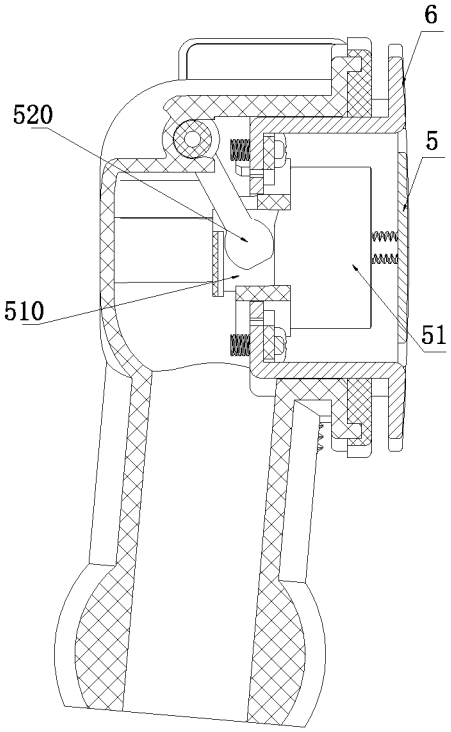
FIG. 4 is a schematic diagram of the position and cooperation of the button slider and the driving rod in the water draining state according to the embodiment of the present invention.
Figure 5:
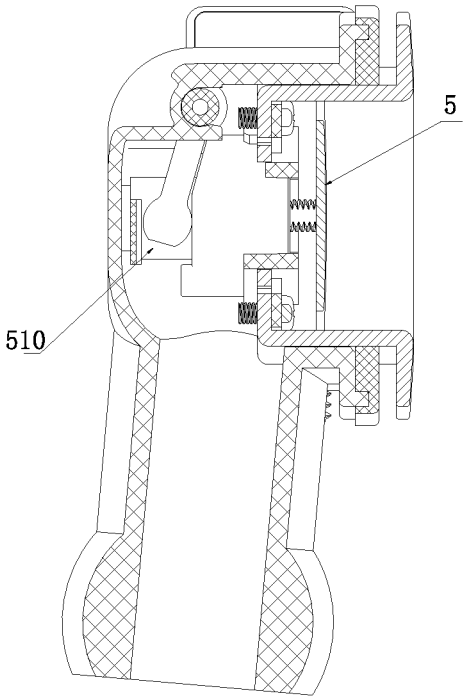
FIG. 5 is a schematic diagram of the position and coordination of the button slider and the driving rod in the water storing state of the embodiment of the invention.
Figure 6:
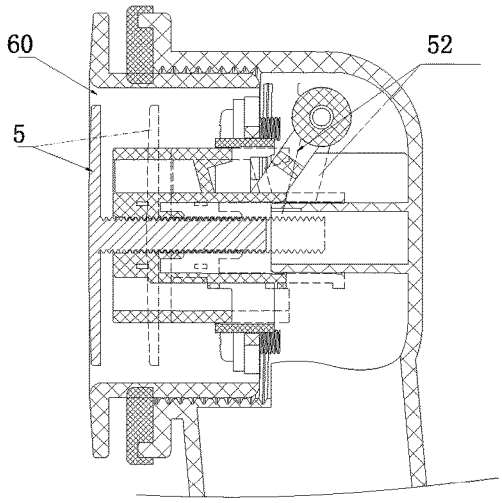
FIG. 6 is a cross-sectional view taken along line A-A of FIG. 3, in which the pressing plate with grid lines is the position of the pressing plate in draining state, and the pressing plate without grid lines is the position of pressing plate in water storing state.
Figure 7:
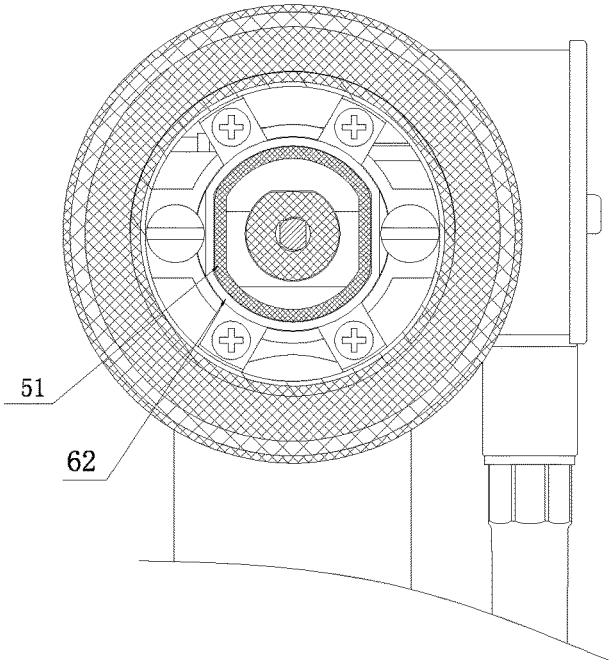
FIG. 7 is a cross-sectional view taken along line B-B of FIG. 2.
Figure 8:
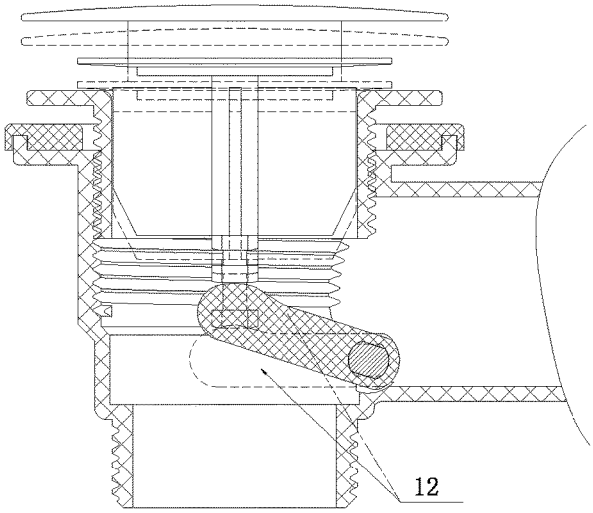
FIG. 8 is a cross-sectional view taken along line C-C of FIG. 3, in which the driving rod with grid lines is the position of the driving rod in draining state, and the driving rod without grid lines is the position of the driving rod in water storing state.
Figure 9:
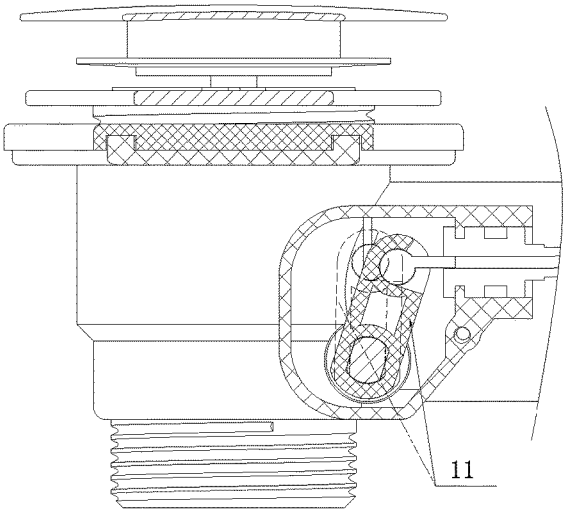
FIG. 9 is a cross-sectional view taken along line D-D of FIG. 3, in which the swing arm with grid lines is the position of the swing arm in draining state, and the swing arm without grid lines is the position of the swing arm in water storing state.
Figure 10:
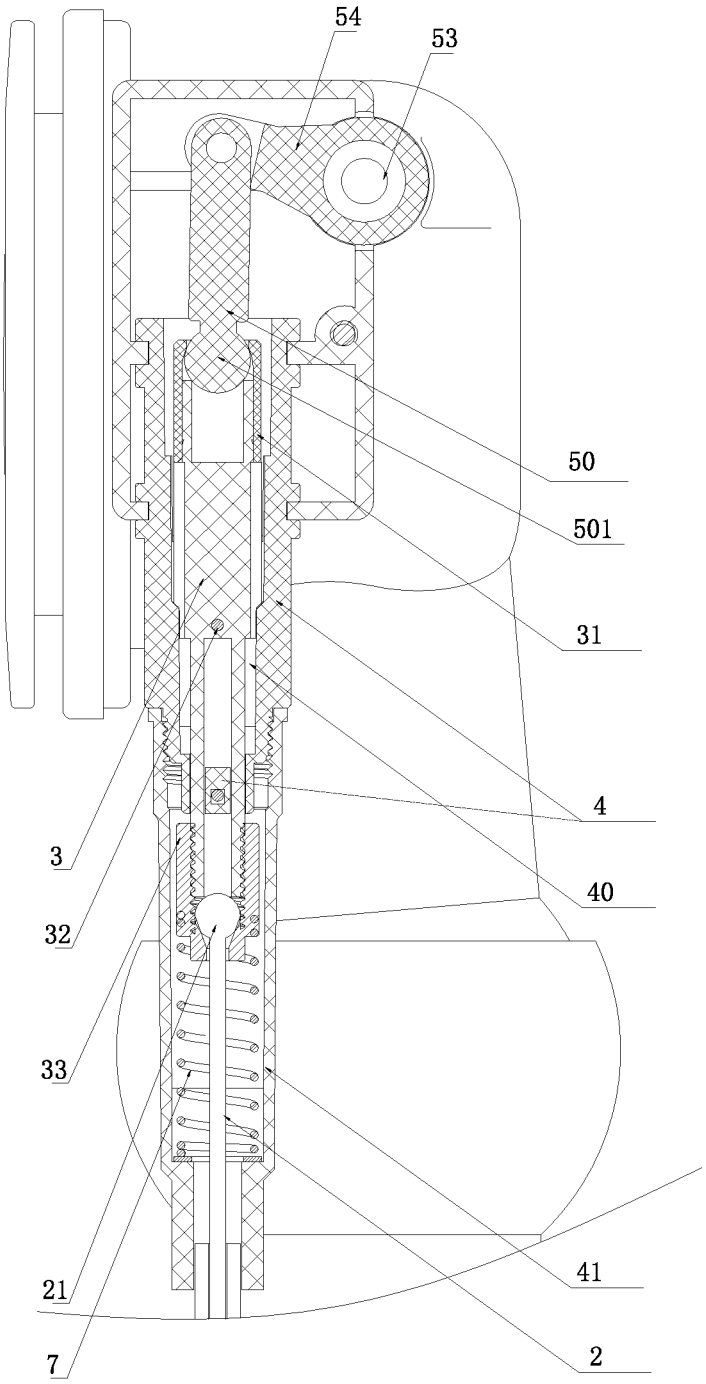
FIG. 10 is a cross-sectional view taken along line E-E of FIG. 3.
Figure 11:
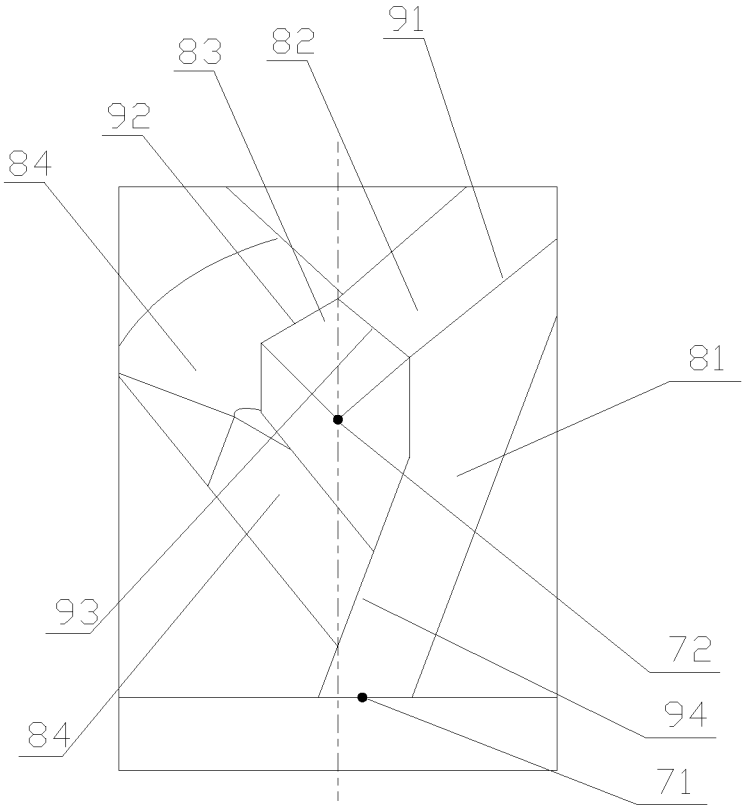
FIG. 11 is a front schematic view of the one-way sliding groove and gear positions of the sliding shaft.

In the embodiment shown in FIGS. 1 to 10, the first working state corresponds to the closing state of the drainage cover, and the second working state is opposite to the first working state, so it corresponds to the opening state of the drainage cover; the press-in and stop position of the button 5 corresponds to the closing state of the drainage cover, and the pop-up and stop position corresponds to the lifting and opening state of the drainage cover; the button can follow the human's reaction and clearly indicate the current position of the drainage cover of the water container, as an indication part of the opening and closing state of the drainage cover, and make the outer edge of the overflow outlet to protect the button when the water is in the state of water accumulation, so as to prevent the button from being triggered by mistake to drain water under the state of water accumulation. It can also be set in the opposite way, that is, the first working state corresponds to the opening state of the drainage cover, and the second working state is opposite to the first working state, so it corresponds to the closing state of the drainage cover. In this way, the press-in and stop position of the button 5 corresponds to the opening state of the drainage cover, and the pop-up and stop position corresponds to the lifting and closing state of the drainage cover. The button can also indicate the current position of the drainage cover, as an indication part of the opening and closing state of the drainage cover; but from this, at the beginning of opening, it can mainly rely on the pressing pressure of hand, which can reduce the requirement for spring, and is more practical for the use of deep water storage; this can be realized by changing the angle of swing arm 11 and driving rod 12 of transmission mechanism.

In the present invention, the lifting control mechanism can also be set in reverse, that is, the upper and lower positions are interchanged, the left and right positions are exchanged, the front and rear positions are exchanged, the dynamic and static relations are exchanged, and the structures with these changes are the same as those of the present invention.

The above is only a specific embodiment of the invention, but the structural features of the invention are not limited to this. Any change or modification made by any person skilled in the art in the field of the present invention is covered by the scope of protection of the present invention.

The invention claimed is:

1. A press-type overflow drainage device for water container, comprising:

a drainage cover mechanism including a drainage cover and a transmission mechanism;

a lifting control mechanism; the lifting control mechanism being provided with up and down movement member and a fixed component with a through hole for the movement of the up and down movement member; and a connecting steel wire, one end of the connecting steel wire being connected with the up and down movement member, and the other end being connected with the transmission mechanism; and a horizontal button assembly which is provided with a button, wherein the lifting control mechanism provides two upper and lower stop positions, so that the up and down movement member can stop at different heights, operate between the lower stop position and the upper stop position with the help of external force pressing and storing and releasing spring energy, and correspondingly push and pull the connecting steel wire to make the transmission mechanism in a first working state and a second working state;

the first working state corresponds to the closing or opening state of the drainage cover, and the second working state corresponds to the opening or closing state of the drainage cover;

the horizontal button assembly is connected with the up and down movement member through a joint member while the corresponding up and down movement member stops in the upper and lower stop positions, and the button has the press-in and stop and pop-up and stop positions at the front and rear of the horizontal position, and the press-in and stop position corresponds to the first working state of the transmission mechanism, and the pop-up and stop position corresponds to the second working state of the transmission mechanism; and the horizontal button assembly includes a horizontal sliding member, a rotary rod, a shaft and a swing arm, and the button is connected with the horizontal sliding member;

the swing arm and the driving rod rotate synchronously through a shaft connection; the swing arm and the joint member are rotatably connected to both sides of the shaft; the horizontal sliding member and the rotary rod are movably clamped with a ball joint; and the rotatable rod extends from the shaft downwardly.

2. The press-type overflow drainage device for water container according to claim 1, wherein the lifting control mechanism is provided with the spring that pushes the up and down movement member from the bottom to top, and accumulates energy when the external force is pressing on the button, and releases the energy after the external force is released; the lifting control mechanism is provided with two upper and lower gears and a sliding groove between the two gears corresponding to the upper and lower stop positions, and the lifting control mechanism is also provided with a blocking hook matched with the gear positions and the sliding groove.

3. The press-type overflow drainage device for water container according to claim 1, wherein the transmission mechanism includes a swing arm and a driving rod which rotate synchronously through a shaft connection, the steel wire is connected with the swing arm, the drainage cover is connected with a lifting shaft, and the lifting shaft is laid on the driving rod; the angular position of the driving rod rotating to the corresponding first working state is a low position, and the angular position of the driving rod rotating to the corresponding second working state is a high position.

4. The press-type overflow drainage device for water container according to claim 1, wherein the horizontal sliding member and the rotary rod can push each other, and the horizontal sliding member and the button are also positioned when the up and down movement member stops in the upper and lower stop positions.

5. The press-type overflow drainage device for water container according to claim 4, wherein the horizontal sliding member is provided with a control groove, and the horizontal sliding member is movably clamped through the connection part of the control groove and the rotary rod.

6. The press-type overflow drainage device for water container according to claim 4, wherein the overflow body of the overflow device of the water container is connected with the overflow pipe, the horizontal sliding member and the rotary rod are arranged in the overflow body, the shaft in the horizontal button assembly can be rotatably connected with the overflow body, the overflow outlet cover of the water container is connected with the overflow body, and a guide component is connected to the portion of the overflow outlet cover inserted into the overflow body or on the overflow body with screws screwed in from the horizontal front; an installation compartment with an openable cover is arranged on the side of the overflow body, and the lower part of the installation compartment is fixedly connected with the fixed component; the swing arm and joint member are arranged in the installation compartment, and the installation compartment has space for the movement of the joint member.

7. The press-type overflow drainage device for water container according to claim 1, wherein one end of the joint member is provided with a joint ball, and the upper end of the up and down movement member is connected with a ball cover, and the joint ball is clamped between the ball cover and the upper end of the up and down movement member.

8. The press-type overflow drainage device for water container according to claim 1, wherein the size of the button is smaller than that of the inner hole of the overflow outlet cover of the water container, and when the button is in the pressed in position, the button is located in the inner hole.

9. The press-type overflow drainage device for water container according to claim 1, wherein the lower part of the fixed component is connected with a bracket, and the spring is in the bracket and pushes up the up and down movement member.

* * * * *